US007399068B2

(12) United States Patent
Anagnostopoulos et al.

(10) Patent No.: US 7,399,068 B2
(45) Date of Patent: Jul. 15, 2008

(54) CONTINUOUS INK JET PRINTING APPARATUS WITH INTEGRAL DEFLECTOR AND GUTTER STRUCTURE

(75) Inventors: Constantine N. Anagnostopoulos, Mendon, NY (US); Bryan A. Beaman, Churchville, NY (US); John A. Lebens, Rush, NY (US); Theodore K. Ricks, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 328 days.

(21) Appl. No.: 11/071,923

(22) Filed: Mar. 4, 2005

(65) Prior Publication Data

US 2006/0197810 A1 Sep. 7, 2006

(51) Int. Cl.
*B41J 2/02* (2006.01)

(52) U.S. Cl. ..... 347/73

(58) Field of Classification Search ..... 347/74, 347/73, 75, 76–80, 82, 28
See application file for complete search history.

(56) References Cited

U.S. PATENT DOCUMENTS

| | | | | |
|---|---|---|---|---|
| 3,786,517 | A * | 1/1974 | Krause | 347/74 |
| 5,475,409 | A | 12/1995 | Simon et al. | |
| 6,079,821 | A | 6/2000 | Chwalek et al. | |
| 6,273,103 | B1 | 8/2001 | Enz et al. | |
| 6,450,619 | B1 | 9/2002 | Anagnostopoulos et al. | |
| 6,463,656 | B1 | 10/2002 | Debesis et al. | |
| 6,554,410 | B2 | 4/2003 | Jeanmaire et al. | |
| 6,663,221 | B2 | 12/2003 | Anagnostopoulos et al. | |
| 2002/0130931 | A1 * | 9/2002 | Hawkins et al. | 347/74 |
| 2003/0016264 | A1 * | 1/2003 | Jeanmaire | 347/28 |
| 2004/0017421 | A1 | 1/2004 | Jeanmaire | |

FOREIGN PATENT DOCUMENTS

| | | |
|---|---|---|
| EP | 1 319 512 | 6/2003 |
| FR | 2 698 584 | 6/1994 |

* cited by examiner

*Primary Examiner*—Kristal Feggins
(74) *Attorney, Agent, or Firm*—Frank Pincelli

(57) ABSTRACT

A continuous stream ink jet printer is provided having an ink droplet forming mechanism for ejecting a stream of ink droplets having a selected one of at least two different volumes toward a print medium and a droplet deflector and ink conduit which are integrally formed to the printhead for producing a flow of gas that interacts with the ink droplet stream to separate droplets having different volumes and collects all droplets not used for printing. The provision of integrally forming the gutter system with the droplet forming mechanism eliminates the requirement to align an external gutter system upon full print engine assembly.

14 Claims, 5 Drawing Sheets

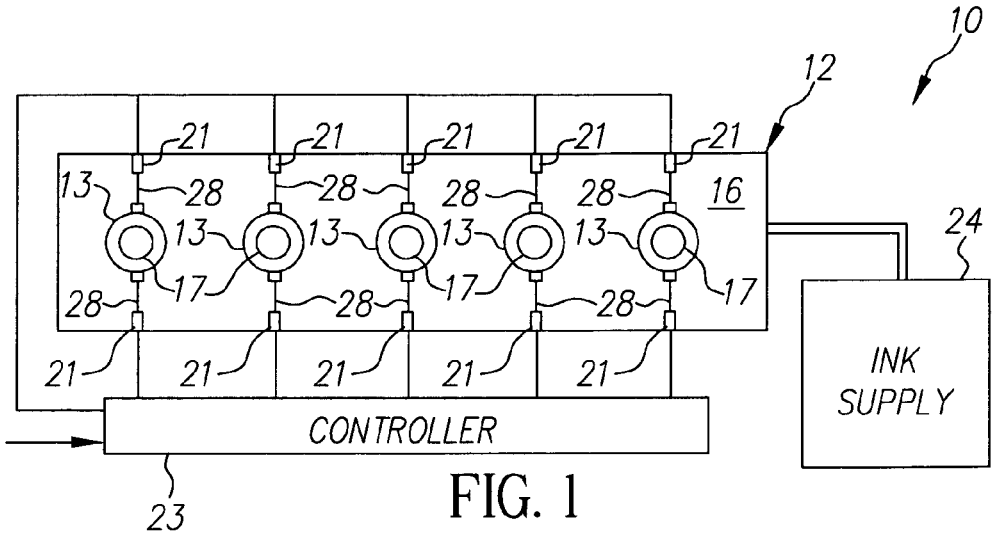
FIG. 1
FIG. 2A
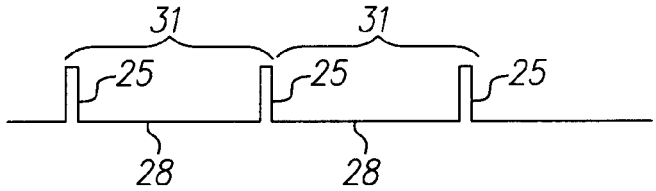
FIG. 2B
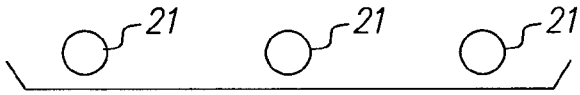
FIG. 2C
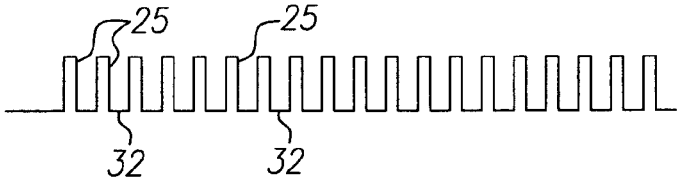
FIG. 2D
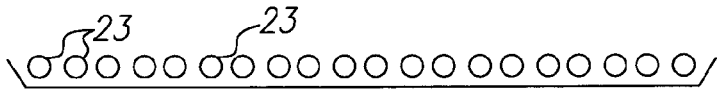
FIG. 2E
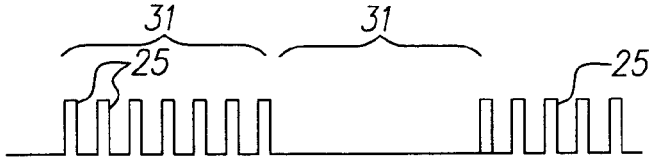
FIG. 2F
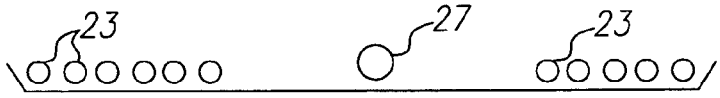

CONTINUOUS INK JET PRINTING APPARATUS WITH INTEGRAL DEFLECTOR AND GUTTER STRUCTURE

FIELD OF THE INVENTION

This invention relates generally to the field of digitally controlled continuous ink jet printing devices, and in particular to continuous ink jet printers in which selected droplets are deflected by a transverse flow of air or gas.

BACKGROUND OF THE INVENTION

U.S. Pat. No. 6,079,821 issued to Chwalek et al. discloses a continuous ink jet printhead in which deflection of selected droplets is accomplished by asymmetric heating of the jet exiting the orifice.

U.S. Pat. No. 6,554,410 by Jeanmaire et al. teaches an improved method of deflecting the selected droplets. This method involves breaking up each jet into small and large drops and creating an air or gas cross flow relative to the direction of the flight of the drops that causes the small drops to deflect into a gutter or ink catcher while the large ones bypass it and land on the medium to write the desired image or the reverse, that is, the large drops are caught by the gutter and the small ones reach the medium.

U.S. Pat. No. 6,450,619 to Anagnostopoulos et al. discloses a method of fabricating nozzle plates, using CMOS and MEMS technologies which can be used in the above printhead. Further, in U.S. Pat. No. 6,663,221, issued to Anagnostopoulos et al., methods are disclosed of fabricating page wide nozzle plates, whereby page wide means nozzle plates that are about 4" long and longer. A nozzle plate, as defined here, consists of an array of nozzles and each nozzle has an exit orifice around which, and in close proximity, is a heater. Logic circuits addressing each heater and drivers to provide current to the heater may be located on the same substrate as the heater or may be external to it.

For a complete continuous ink jet printhead, besides the nozzle plate and its associated electronics, a means to deflect the selected droplets is required, an ink gutter or catcher to collect the unselected droplets, an ink recirculation or disposal system, various air and ink filters, ink and air supply means and other mounting and aligning hardware are needed.

In these continuous ink jet printheads the nozzles in the nozzle plates are arranged in a straight line, they are between about 150 to 2400 per inch and, depending on the exit orifice diameter, can produce droplets as large as about 100 Pico liters and as small as 1 Pico liter.

As already mentioned, all continuous ink jet printheads, including those that depend on electrostatic deflection of the selected droplets (see for example U.S. Pat. No. 5,475,409 issued to Simon et al), an ink gutter or catcher 10 is needed to collect the unselected droplets. Such a gutter has to be carefully aligned relative to the nozzle array since the angular separation between the selected and unselected droplets is, typically, only a few degrees. The alignment process is typically a very laborious procedure and increases substantially the cost of the printhead. The printhead cost is also increased because each gutter must be aligned to its corresponding nozzle plate individually and one at a time.

The gutter or catcher may contain a knife-edge or some other type of edge to collect the unselected droplets, and that edge has to be straight to within a few tens of microns from one end to the other. Gutters are typically made of materials that are different from the nozzle plate and as such they have different thermal coefficients of expansion so that if the ambient temperature changes the gutter and nozzle array can be in enough misalignment to cause the printhead to fail. Since the gutter is typically attached to some frame using alignment screws, the alignment can be lost if the printhead assembly is subjected to shock as can happen during shipment. If the gutter is attached to the frame using an adhesive, misalignment can occur during the curing of the glue as it hardens, resulting in yield loss of printheads during their assembly.

These problems of alignment and assembly are exacerbated as the printhead lengths are increased from an inch or less to page wide which could be tens of inches long.

A need therefore exists for an assembly free and self-aligned ink gutter or catcher for page wide nozzle arrays that is free of misalignment due to changes in the ambient or operating temperature. Furthermore, a need exists for an ink gutter or catcher that is assembly free and self aligned to smaller nozzle arrays, which may then be arranged in a staggered or tiled configuration to form page wide continuous ink jet printheads. Finally, a need exists to reduce the cost of the printheads by eliminating the labor-intensive alignment procedure and the one at a time alignment process of each nozzle plate to its corresponding gutter.

SUMMARY OF THE INVENTION

The invention is directed to an ink jet printing apparatus and method of fabrication that solves or at least ameliorates some or all of the aforementioned problems associated with the prior art.

In accordance with one aspect of the present invention there is provided an ink jet printing apparatus comprising an ink droplet forming mechanism for ejecting a stream of ink droplets having a selected one of at least two different volumes toward a print medium and an integral deflector gutter structure which is integrally formed to the printhead for providing a flow of gas that interacts with the ink droplet stream to separate ink droplets having the different volumes from one another and captures excess ink from one of the at least two different volumes of the ink droplets.

In accordance with another aspect of the present invention there is provided a method of making an ink-jet printhead having an integral gutter, comprising the steps of:

a. providing a support substrate on which an ink jet printhead is integrally formed, the printhead ejecting a stream of ink droplets having a selected one of at least two different volumes toward a print medium;

b. forming a deflector gutter structure integrally on the support substrate, the deflector gutter structure having at least one passage for directing a stream of gas against the stream of ink droplets for deflecting the stream of ink droplets and at least one passageway for capturing one of the at least two different volumes of the ink droplets.

In accordance with another aspect of the invention there is provided an ink-jet printing apparatus comprising a plurality of ink-jet print assemblies positioned with respect to each other so as to form a single line of print on a media, each of said ink-jet print assemblies having an ink droplet forming mechanism for ejecting a stream of ink droplets having a selected one of at least two different volumes toward a print medium and an integral deflector gutter structure which is integrally formed to each of the printheads for providing a flow of gas that interacts with said ink droplet stream to separate ink droplets having said different volumes from one another and captures excess ink from said at least two different volumes of said ink droplets.

These and other aspects, objects, features and advantages of the present invention will be more clearly understood and appreciated from a review of the following detailed description of the preferred embodiments and appended claims and by reference to the accompanying drawings.

BRIEF DESCRIPTION OF THE DRAWINGS

In the detailed description of the preferred embodiments of the invention presented below, reference is made to the accompanying drawings in which:

FIG. 1 is a schematic plan view of a printhead/nozzle array made in accordance with a preferred embodiment of the present invention;

FIGS. 2A-F illustrates the relationship between the switching frequency of the heaters of the nozzle array and the volume of ink droplets produced by the nozzles adjacent to the heaters;

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those of ordinary skill in the art.

Figure 4:
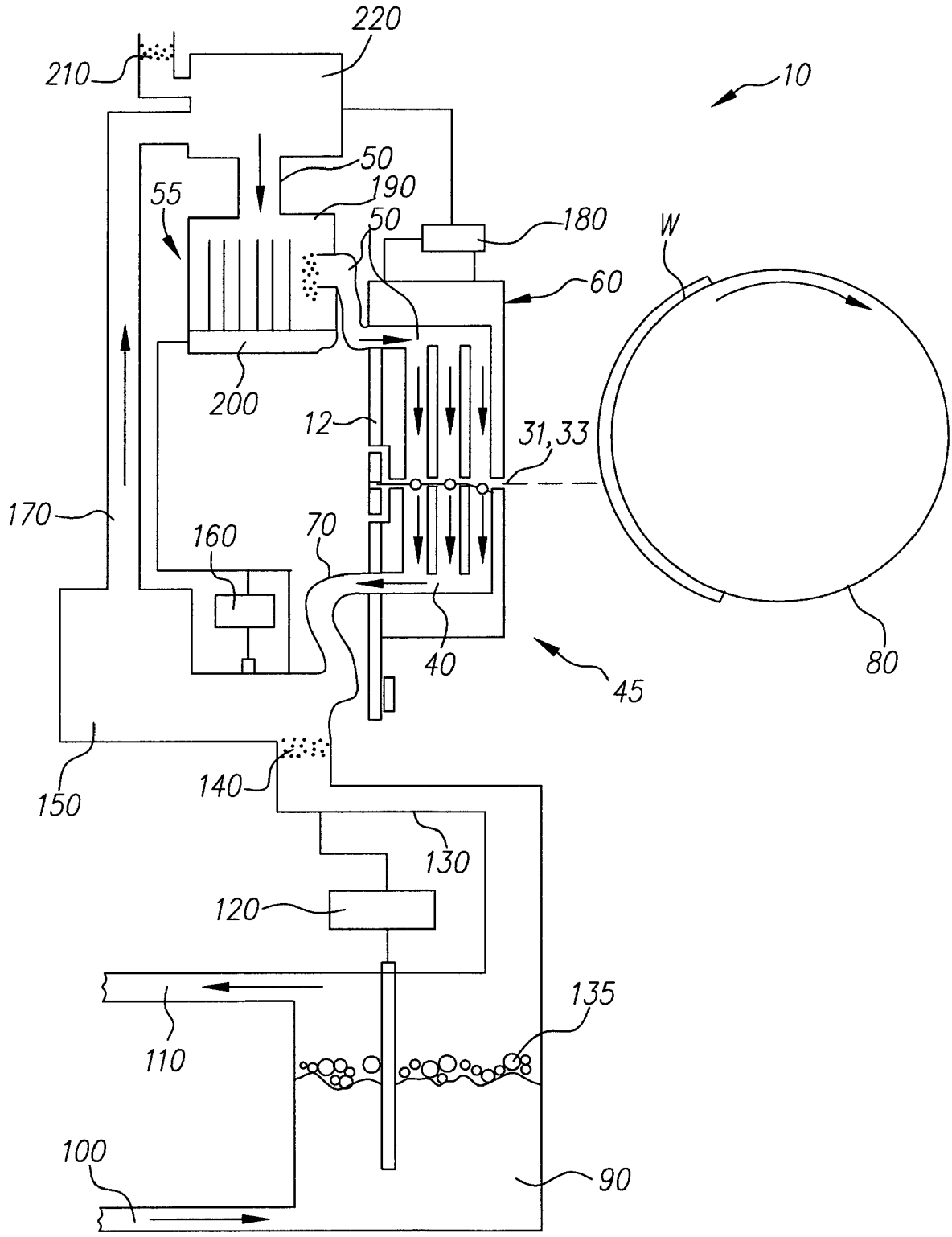
FIG. 4 is schematic side view of an ink jet printer made in accordance with a preferred embodiment of the present invention.

With reference to FIGS. 1 and 4, wherein like reference numerals designate like components throughout all of the several figures, the continuous stream printer 10 of the invention generally comprises an ink droplet forming mechanism in the form of a nozzle array 12. In the embodiment illustrated the ink droplet forming mechanism comprises an ink jet printhead for use in an ink jet printer.

Referring in particular to FIG. 1, there is illustrated a plurality of annular heaters 13 which are at least partially formed or positioned on a silicon substrate 16 of nozzle array/printhead 12 around each corresponding nozzle 17. Although each heater 13 may be disposed in various ways about each nozzle, such as in the neck of the nozzle 17 or at the bottom of it, the heaters 13 are preferably disposed close to corresponding nozzles 17 in a concentric manner. In a preferred embodiment, heaters 13 are formed in a substantially circular or ring shape. However, it is specifically contemplated that heaters 13 may be formed in a partial ring, square, or other shape adjacent to the nozzles 17. Each heater 13 in a preferred embodiment is principally comprised of a resistive heating element electrically connected to contact pads 21 via conductors 28. Each nozzle 17 is in fluid communication with ink supply 24 through an ink passage (not shown) formed in the substrate 16 of the nozzle array 12. It is specifically contemplated that nozzle array 12 may incorporate additional ink supplies in the same manner as supply 24 as well as additional corresponding nozzles 17 in order to provide color printing using three or more ink colors. Additionally, black and white or single color printing may be accomplished using a single ink supply 24 and nozzle 17.

Conductors 28 and electrical contact pads 21 may be at least partially formed or positioned on the nozzle array substrate 12 and provide an electrical connection between a controller 23 and the heaters 13. Alternatively, the electrical connection between the controller 23 and heater 13 may be accomplished in any well-known manner. Controller 23 may be a relatively simple device (a switchable power supply for heater 13, etc.) or a relatively complex device (a logic controller or programmable microprocessor in combination with a power supply) operable to control many other components of the printer in a desired manner.

In FIGS. 2A-F, examples of the electrical activation waveforms provided by controller 23 to the heaters 13 are shown and their associated ink droplet size produced by the waveforms. Generally, a high frequency of activation of heater 13 results in small volume droplets 33 as shown in FIGS. 2C and 2D, while a low frequency of activation results in large volume droplets 31 as illustrated in FIGS. 2A and 2B. In the preferred embodiment, large ink droplets are to be used for marking the print medium, while smaller droplets are captured for ink recycling. It must be understood, however, that this could be reversed in operation (depending on imaging requirements), where the smaller droplets are used for printing, and the larger drops recycled. Also in this example, only one printing droplet is provided for per image pixel, thus there are two states of heater actuation, printing or non-printing. The electrical waveform of heater 13 actuation for large ink droplets 31 is presented schematically as FIG. 2A. The individual large ink drops 31 produced from the jetting of ink from nozzle 17 as a result of low frequency heater actuation are shown schematically in FIG. 2B. Heater actuation time 25 is typically 0.1 to 5 microseconds in duration, and in this example is 1.0 microsecond. The delay time 38 between subsequent heater actuation is 42 microseconds. The electrical waveform of heater 13 actuation for the non-printing case is given schematically as FIG. 2C. Electrical pulse 35 is 1.0 microsecond in duration, and the time delay 42 between activation pulses is 6.0 microseconds. The small droplets 23, as illustrated in FIG. 2D, are the result of the activation of heater 13 with this non-printing waveform.

FIG. 2E is a schematic representation of an electrical waveform of heater activation for mixed image data where a transition is shown from the non-printing state to the printing state, and back to the non-printing state. Schematic representation in FIG. 2F is the resultant droplet stream formed. It is apparent that heater activation may be controlled independently based on the ink color required and ejected through corresponding nozzles 17, the movement of nozzle array 12 relative to a print media W, and an image to be printed. It is specifically contemplated that the absolute volume of the small droplets 2 3 and the large droplets 27 may be adjusted based upon specific printing requirements such as ink and media type or image format and size.

Figure 3:
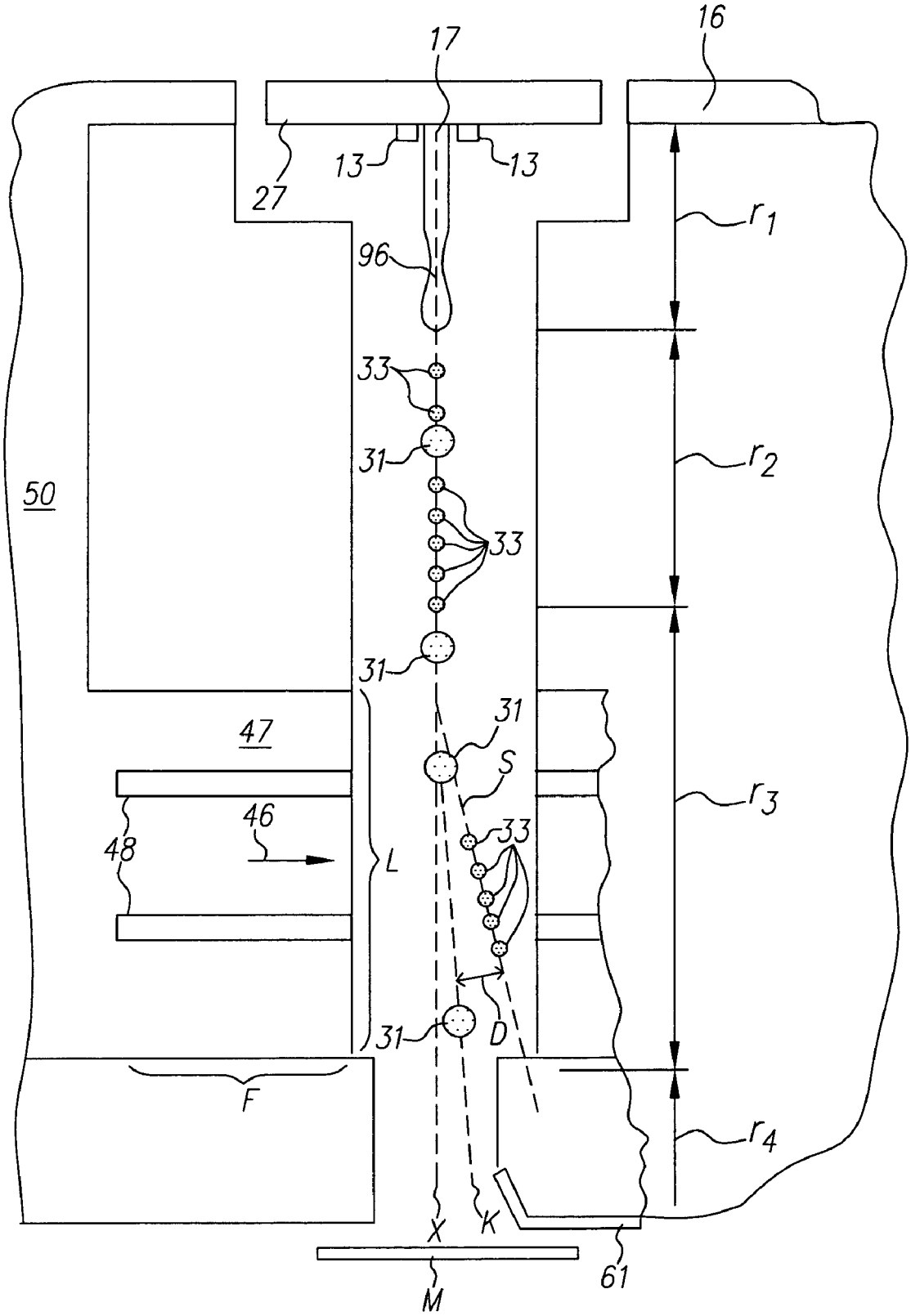
FIG. 3 is an enlarged schematic side view of the operation of a nozzle array made in accordance with the preferred embodiment of the present invention illustrating how the droplet deflector deflects smaller volume droplets from larger volume droplets.

With reference now to FIG. 3, the operation of nozzle array 12 in a manner such as to provide an image-wise modulation of droplets, as described above, is coupled with a droplet deflector 45 of integral gutter structure 61 (as later described in detail and illustrated by FIG. 5). The deflector 45 separates the droplets into printing or non-printing paths according to drop volume by means of a transversely disposed gas flow 47.

Ink is ejected through nozzle 17 in nozzle array 12, creating a filament of working fluid 96 moving substantially perpendicular to nozzle array 12 along axis X. The physical region over which the filament of working fluid is intact is designated as $r_1$. Heater 13 is selectively actuated at various frequencies according to image data, causing filament of working fluid 96 to break up into a stream of individual ink droplets. Some coalescence of droplets often occurs in forming non-printing drops 31. This region of jet break-up and drop coalescence is designated as $r_2$. Following region $r_2$, drop formation is complete in region $r_3$, such that at the distance from the nozzle array 12 that the gas flow from the deflector 45 is applied, droplets are substantially in two size classes: small, printing drops 33 and large, non-printing drops 31. In the preferred implementation, the force 46 provided by the gas flow 47 is perpendicular to axis X. The force 46 acts across distance L, which is less than or equal to distance $r_3$. Because area increases with the square of the radius of a sphere while mass increases with the cube of the radius, large, non-printing droplets 31 have a greater mass and more momentum than small volume droplets 33 which more than offsets the greater force applied to them by the gas flow as a result of their layer area. As gas force 46 interacts with the stream of ink droplets, the individual ink droplets separate depending on each droplet's volume and mass. Accordingly, the gas flow rate can be adjusted to create a sufficient differentiation angle D in the small droplet path S from the large droplet path K, permitting large droplets 31 to strike print media M while small, non-printing droplets 33 are captured by an ink guttering structure 60 described in more detail in the apparatus below.

An amount of separation D between the large, non-printing droplets 31 and the small, printing droplets 33 will not only depend on their relative size but also the velocity, density, and viscosity of the gas flow producing force 46, the velocity and density of the large printing droplets 31 and small, non-printing droplets 33, and the interaction distance (shown as L in FIG. 3) over which the large printing droplet 31 and the small, non-printing droplets 33 interact with the gas flow 47. Gases, including air, nitrogen, etc., having different densities and viscosities can also be used with similar results.

Figure 5:
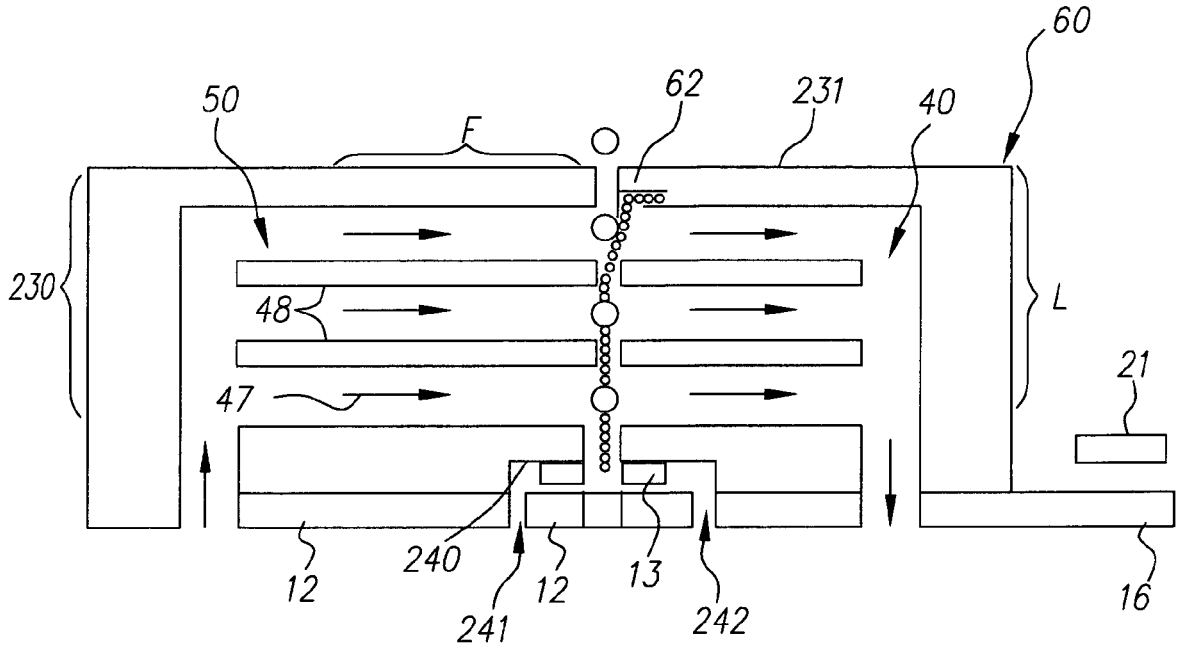
FIG. 5 is a schematic side view of a nozzle array and integral gutter system made in accordance with a preferred embodiment of the present invention.

Referring to FIGS. 3, 4 and 5, a printing apparatus (typically, an ink jet printer or printhead) used in a preferred implementation of the current invention is shown schematically. The printer 10 includes an integral deflector gutter structure 60 that has been integrally formed as a part of the ink-jet nozzle array 12. Large volume ink droplets 31 and small volume ink droplets 33 are formed from ink ejected from the ink droplet forming mechanism/printhead 12 substantially along ejection path X in a stream. The integral deflector gutter structure 60 includes an inlet plenum 50 and an outlet plenum 40 for directing a gas through integral deflector gutter structure 60 and against the ink droplets for separating the different size ink droplets. The integral deflector gutter structure 60 also includes a droplet deflector 62 that is positioned adjacent to an outlet plenum 40. The purpose of deflector 62 is to intercept the displaced small droplets 23, while allowing large ink droplets 31 traveling along small droplet path S to continue on to the recording media M carried by print drum 80. Plenums 40, 50 include baffles 48 which facilitates a laminar flow of gas. Vacuum pump 150 communicates with plenum 40 and provides a sink for the gas flow 47. In the center of the droplet deflector 62 is positioned proximate path X. The application of force 46 due to gas flow 47 separates the ink droplets into small-drop path S and large-drop path K. Pump 220 draws in air, while filter 210 removes dust and dirt particles. In the preferred embodiment, the flow distance F of the upper plenum 50 is of sufficient length to allow full formation of a laminar airflow. As previously discussed, baffles 48 in plenums 40, 50 in the integral deflector gutter structure 60 facilitate increased gas flow 47 velocity while maintaining laminar flow.

An ink recovery conduit/passageway 70 is connected to outlet plenum 40 of integral deflector gutter structure 60 for receiving droplets recovered by deflector 62. Ink recovery conduit 70 communicates with ink recovery reservoir 90 to facilitate recovery of non-printed ink droplets by an ink return line 100 for subsequent reuse. Ink recovery reservoir contains open-cell sponge or foam 135, which prevents ink sloshing in applications where the nozzle array 12 is rapidly scanned. A vacuum conduit 110, coupled to a negative pressure source, can communicate with ink recovery reservoir 90 to create a negative pressure in ink recovery conduit 70 improving ink droplet separation and ink droplet removal. The gas flow rate in ink recovery conduit 70, however, is chosen so as to not significantly perturb large droplet path K. Lower plenum 40 is fitted with filter 140 and drain 130 to capture any ink fluid resulting from ink misting, or misdirected jets which has been captured by the air flow in plenum 40. Captured ink is then returned to recovery reservoir 90.

Additionally, a portion of plenum 50 diverts a small fraction of the gas flow from pump 220 and conditioning chamber 190 to provide a source for the gas which is drawn into ink recovery conduit 70. The gas pressure at gutter deflector 62 and in ink recovery conduit 70 are adjusted in combination with the design of ink recovery conduit 70 and plenum 50 so that the gas pressure in the printhead assembly near integral deflector gutter structure 60 is positive with respect to the ambient air pressure near print drum 80. Environmental dust and paper fibers are thusly discouraged from approaching and adhering to integral deflector gutter structure 60 and are additionally excluded from entering ink recovery conduit 70.

In operation, a recording medium M is transported in a direction transverse to axis X by print drum 80 in a known manner. Transport of recording medium M is coordinated with movement of printhead/nozzle array mechanism, not shown, for movement of nozzle array 12. This can be accomplished using controller 13 in a known manner. Recording media M may be selected from a wide variety of materials including paper, vinyl, cloth, other fibrous materials, etc.

The recovery air plenums 40, 50 of integral deflector gutter structure 60 is integrally formed on nozzle array 12. In the preferred embodiment, an orifice cleaning system 240 may also be incorporated into integral deflector gutter structure 60. Cleaning would be accomplished by flooding the nozzle array 12 with solvent injected through the input port 241. Used solvent is removed by drawing vacuum on the cleaning solvent through output port 242.

In the present invention the guttering structure is integrally formed with nozzle array 12. This is done in order to maintain accuracy between the ink jet nozzles 17 and the deflector 62. In a preferred embodiment of the present invention, nozzle array 12 is formed from a semiconductor material (silicon, etc.) using known semiconductor fabrication techniques (CMOS circuit fabrication techniques, micro-electro mechanical structure (MEMS) fabrication techniques, etc.). Such techniques are illustrated in U.S. Pat. Nos. 6,663,221 and 6,450,619 which are hereby incorporated by reference in their entirety. However, it is specifically contemplated and therefore within the scope of this disclosure that nozzle array 12 may be integrally formed with the gutter structure from any materials using any fabrication techniques conventionally known in the art.

Figure 6:
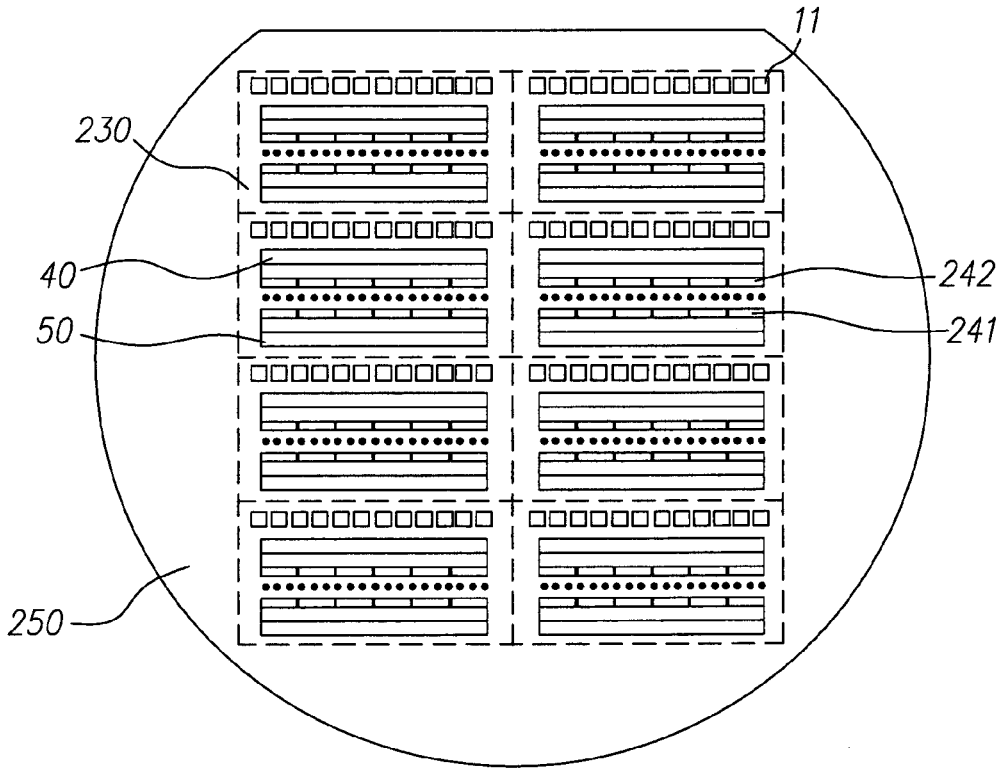
FIG. 6 is a schematic top view of a nozzle plate wafer prior to singulation with integral gutter system made in accordance with a preferred embodiment of the present invention.
Figure 7:
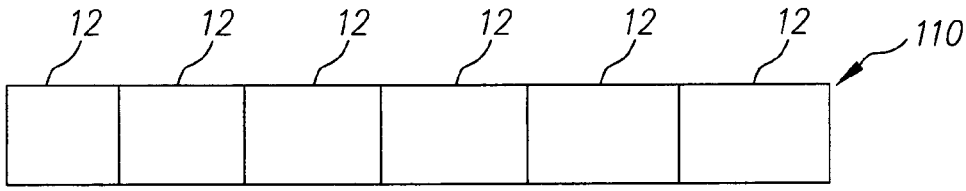
FIG. 7 illustrates an ink jet printhead assembly comprising a plurality of printhead and integral gutter made in accordance with the present invention.

Referring to FIG. 6 there is illustrated a wafer 250 incorporating a plurality of integrally formed ink-jet printhead 12 and integral deflector gutter structure 60 of FIG. 5. In the construction of wafer 250 having a plurality of integral printheads and gutter structure, a first layer is constructed which incorporates ink-jet printhead 12. After the first layer has been formed, then integral deflector gutter structure 60 is formed directly thereon using normal photolithographic techniques until integral deflector gutter structure 60 is formed on each of the respective printheads 12. The photolithographic techniques allows for precise positioning of the orifices 17 with respect to the deflector 62. Once formed the individual printheads 12 and integral deflector gutter structure 60 are separated. Then a plurality of integral printheads 15 and deflector gutter structures 60 may be combined together as illustrated by FIG. 7 to form a long continuous printhead 110 that can print along the entire with of a media. The individual integral printheads 12 can be simply positioned so that the printing nozzles 17 of all the printheads 12 are aligned for printing along a straight line. Since the individual nozzles 17 of each of the printheads are aligned with its respect deflector 62, mis-spraying will be avoided. Using this technique, ink-jet printhead assemblies for continuous ink-jet printers can be made in lengths of up to 36 inches or greater, as desired.

Figure 8:
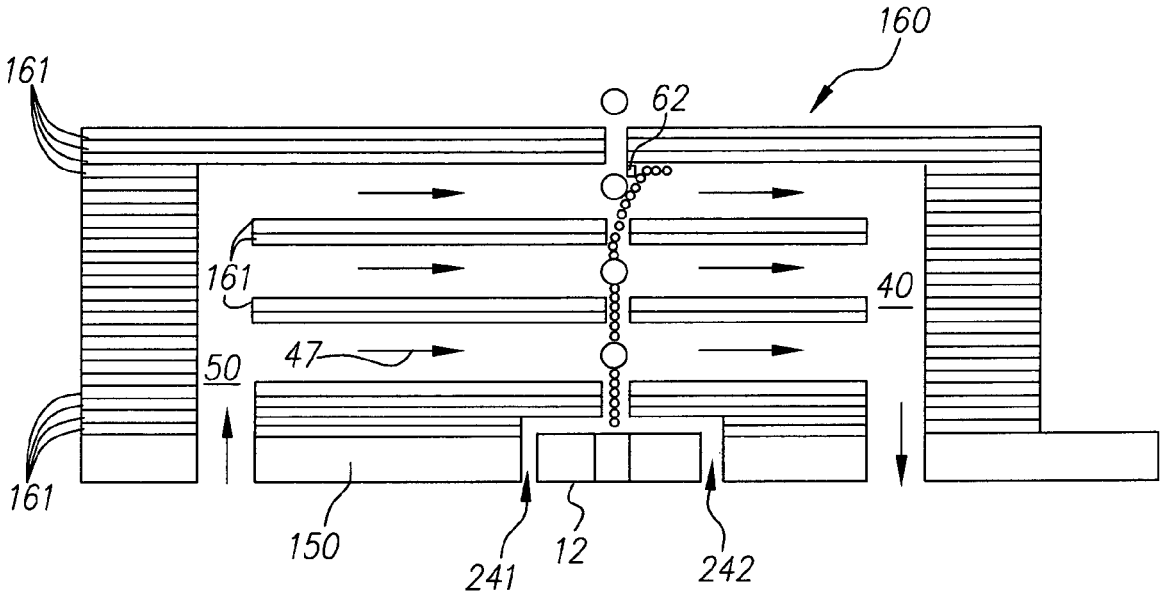
FIG. 8 illustrates a modified ink jet nozzle plate structure made in accordance with the present invention.

Referring to FIG. 8 there is illustrated a modified integral ink-jet printhead 12 and gutter structures also made in accordance with the present invention; like numerals indicating like parts and operation as previously discussed. In this embodiment, the integral deflector gutter structure 160 is composed of a plurality of laminated sub-layers 161 of a photoimageable material (such as polyimide) bonded to stiffening material (such as stainless steel). The sub-layers are patterned and selectively etched with functional and alignment features. The sub-layers are then stacked and cured under heat and vacuum to form multiple integral deflector gutter structure 160 that correspond to printheads on the printhead wafer 150. This structure is aligned and bonded to the wafer 150, which is then singulated into individual printheads 12. A description of materials and processes for fabricating laminated ink jet structures can be found in U.S. Pat. No. 6,463,656.

It is specifically contemplated that integral deflector gutter structure 160 or 150 may be formed from any materials using any fabrication techniques conventionally known in the art, including high aspect photo resist, such as SU-8 so long as the integral deflector gutter structure in integrally. The structure may be attached prior to or following printhead singulation.

While the foregoing description includes many details and specificities, it is to be understood that these have been included for purposes of explanation only, and are not to be interpreted as limitations of the present invention. Many modifications to the embodiments described above can be made without departing from the scope of the invention, as is intended to be encompassed by the following claims and their legal equivalents.

PARTS LIST

10 printer
12 printhead/nozzle array
13 controller
13 Heater
16 silicon substrate
17 Nozzle
21 contact pad
23 small droplets
23 controller
24 ink supply
25 actuation time
27 large droplets
28 conductor
31 large drop
33 small drop
35 electrical pulse time
38 delay time
40 exit plenum
41 pixel time
42 delay time
45 droplet deflector
46 force
47 gas flow
48 baffles
50 Entry plenum
60 guttering structure
61 gutter structure
62 droplet deflector
70 ink recovery conduit
80 print drum
90 ink recovery reservoir
96 working fluid
100 ink return line
102 first layer
110 vacuum conduit
130 ink return line
135 foam
140 filter
150 vacuum pump
150 printhead wafer
160 gutter structure
161 sub-layers
170 gas recycling line
190 conditioning chamber
210 intake filter
220 pressure pump
230 integral gutter structure
231 integral gutter sub-layer
240 orifice cleaning system
241 solvent inlet port
242 solvent evacuation port
250 printhead wafer
D separation distance
F air flow distance
K Large droplet path
L interaction distance
M pint media
S small droplet path
W print media
X ejection path

The invention claimed is:

1. An ink-jet printing apparatus comprising an ink droplet forming mechanism for ejecting a stream of ink droplets having a selected one of at least two different volumes toward a print medium and an integral deflector gutter structure which is integrally formed with the printhead for providing a flow of gas that interacts with said ink droplet stream to separate ink droplets having said different volumes from one another and captures excess ink from one of said at least two different volumes of said ink droplets.

2. The ink-jet printing apparatus defined in claim 1 further comprising a cleaning mechanism which is integral into said integral printhead and said integral deflector gutter structure.

3. The ink-jet printing apparatus defined in claim 1 wherein said integral deflector gutter structure comprises at least on passage for directing said flow of gas toward said ink droplet stream and at least one passage for removing said gas flow out of said integral deflector gutter structure and from said ink droplet stream.

4. The ink-jet printing apparatus defined in claim 1 wherein at least one passage is provided for removing said captured excess ink from said integral deflector gutter structure.

5. The ink-jet printing apparatus as defined in claim 3 wherein said at least one passage includes at least one baffler for providing laminar flow of said flow of gas toward said ink droplet stream.

6. The ink-jet printing apparatus defined in claim 1 wherein said printhead and integral deflector gutter structure is made using CMOS circuit fabrication techniques.

7. The ink-jet printing apparatus defined in claim 1 wherein said printhead and integral deflector gutter structure is made using micro-electro mechanical structure (MEMS) fabrication techniques.

8. The ink-jet printing apparatus defined in claim 1 wherein said apparatus comprises a continuous ink-jet printing apparatus.

9. A method of making an ink-jet printhead having an integral gutter, comprising the steps of:

a. providing a support substrate on which an ink-jet printhead is integrally formed, said ink-jet printhead ejecting a stream of ink droplets having a selected one of at least two different volumes toward a print medium;

b. integrally forming a deflector gutter structure with said printhead by forming a deflector gutter structure integrally on said support substrate, said deflector gutter structure having at least one passage for directing a stream of gas against said stream of ink droplets for deflecting said stream of ink droplets and at least one passageway for capturing one of said at least two different volumes of said ink droplets.

10. The method according to claim 9 wherein said ink-jet printhead and said deflector gutter structure is integrally formed using CMOS circuit fabrication techniques.

11. The method according to claim 9 wherein said ink-jet printhead and said deflector gutter structure is integrally formed using micro-electro mechanical structure (MEMS) fabrication techniques.

12. An ink-jet printing apparatus comprising a plurality of ink-jet print assemblies positioned with respect to each other so as to form a single line of print on a media, each of said ink-jet print assemblies having an ink droplet forming mechanism for ejecting a stream of ink droplets having a selected one of at least two different volumes toward a print medium and an integral deflector gutter structure which is integrally formed with each of the printheads for providing a flow of gas that interacts with said ink droplet stream to separate ink droplets having said different volumes from one another and captures excess ink from said at least two different volumes of said ink droplets.

13. An ink-jet printing apparatus according to claim 12 wherein said ink droplet forming mechanism comprises a plurality of nozzles.

14. An ink-jet printing apparatus according to claim 13 wherein said nozzles of said plurality of ink-jet assemblies are aligned so as to form said single line of print.

* * * * *